US006973906B2

(12) United States Patent
Yoshida et al.

(10) Patent No.: US 6,973,906 B2
(45) Date of Patent: Dec. 13, 2005

(54) INTERNAL COMBUSTION ENGINE PROVIDED WITH DECOMPRESSING MECHANISM AND METHOD OF ADJUSTING VALVE LIFT FOR DECOMPRESSION

(75) Inventors: Hiroyuki Yoshida, Wako (JP); Tomonori Ikuma, Wako (JP); Mitsuharu Tanaka, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/358,011

(22) Filed: Feb. 4, 2003

(65) Prior Publication Data

US 2003/0145820 A1 Aug. 7, 2003

(30) Foreign Application Priority Data

Feb. 6, 2002 (JP) ..... 2002-029878
Feb. 6, 2002 (JP) ..... 2002-029879

(51) Int. Cl.[7] ..... F01L 13/08
(52) U.S. Cl. ..... 123/182.1; 29/888.01
(58) Field of Search ..... 123/182.1

(56) References Cited

U.S. PATENT DOCUMENTS 2,850,002 A * 9/1958 Hovel ..... 123/182.1
3,395,689 A 8/1968 Kruse
4,394,851 A * 7/1983 Greier et al. ..... 123/182.1
4,898,133 A 2/1990 Bader
5,443,044 A * 8/1995 VanRens ..... 123/195 HC
5,809,958 A 9/1998 Gracyalny
5,823,153 A 10/1998 Santi et al.
6,755,168 B2 * 6/2004 Schneider et al. ..... 123/182.1

FOREIGN PATENT DOCUMENTS

EP 1 247 951 A 9/2002
JP 63-246404 10/1988
JP 11-294130 10/1999
JP 11294130 10/1999
JP 2001-221023 8/2001

* cited by examiner

*Primary Examiner*—Andrew M. Dolinar
(74) *Attorney, Agent, or Firm*—Carrier, Blackman & Associates, P.C.; Joseph P. Carrier; William D. Blackman

(57) ABSTRACT

A decompressing mechanism (D) for an internal combustion engine (E) is incorporated into a camshaft (15) provided with a bore (54) extending in the direction of the arrow (A) along the axis (L1) of rotation of the camshaft (15). The decompressing mechanism (D) includes a decompression member (80) formed by metal injection and integrally having a flyweight (81), a decompression cam (82) for exerting a valve-opening force through an exhaust rocker arm (48) on an exhaust valve, and an arm (83) connecting the flyweight (81) and the decompression cam (82). The flyweight (81) is supported for swing motion by a pin (71) on the camshaft (15). The axis (L2) of swing motion of the flyweight (81) is included in a plane (P4) substantially perpendicular to the axis (L1) of rotation, and does not intersect the axis (L1) of rotation and the bore (54) of the camshaft (15). The fully expanded decompression member (80) revolves in a cylindrical space of a small diameter around the camshaft (15).

16 Claims, 9 Drawing Sheets

INTERNAL COMBUSTION ENGINE PROVIDED WITH DECOMPRESSING MECHANISM AND METHOD OF ADJUSTING VALVE LIFT FOR DECOMPRESSION

BACKGROUND OF THE INVENTION

1. Field of the Invention

The present invention relates to an internal combustion engine provided with a centrifugal decompressing means for reducing compression pressure to facilitate staring the internal combustion engine by opening a valve included in the internal combustion engine during the compression stroke in starting the internal combustion engine, and a method of adjusting valve lift for decompression.

2. Description of the Related Art

Internal combustion engines provided with a centrifugal decompressing means including a flyweight are disclosed in JP2001-221023A and JP63-246404A. A decompression member included in the decompressing means disclosed in JP2001-221023A or JP63-246404A is a plate-shaped member of a substantially uniform thickness integrally provided with a flyweight and a decompression cam. A support pin supporting the flyweight for swing motion is extended through a middle part of a camshaft substantially perpendicularly to the axis of the camshaft. It is difficult to form the camshaft in a lightweight, hollow member and to form an oil passage through the camshaft when the support pin supporting the flyweight of the decompressing means is extended through the camshaft substantially perpendicularly to the axis of rotation of the camshaft.

An internal combustion engine proposed in JP11-294130A is provided with a decompressing means including a flyweight supported for swing motion by a pin on a camshaft provided with a central oil passage. This prior art internal combustion engine has a camshaft provided with a cam held in contact with a valve tappet, and a central oil passage; and a compressing means including a decompression member having the shape of a plate of a substantially uniform thickness and a function of a flyweight, and a return spring. The decompression member is provided with a protrusion, which corresponds to a decompression cam, formed integrally with a flyweight. The protrusion lifts up the valve tappet in a starting phase of the internal combustion engine to open an exhaust valve. The decompression member is supported for swing motion by a pair of pins placed on the camshaft at positions deviated from the central part provided with the oil passage of the camshaft.

In the decompressing means disclosed in JP11-294130A, the pair of pins are disposed on a diameter of the camshaft, the axis of turning of the decompression member, similarly to those of the decompressing means disclosed in JP2001-221023A and JP63-246404A, is substantially perpendicular to the axis of rotation of the camshaft. Therefore, it is difficult to secure a space in which a fully expanded flyweight included in the decompressing means revolves about the axis of rotation of the camshaft, i.e., to narrow a cylindrical space in which a fully expanded flyweight included in the decompressing means revolves about the axis of rotation of the camshaft, and hence a comparatively large space must be secured for the decompressing means around the camshaft, which increases the size of the internal combustion engine. For example, it is difficult for the prior art supposed to extend the center axis of turning substantially perpendicularly to the axis of rotation of the camshaft to narrow the space necessary for the revolution of the fully expanded decompression member because the prior art needs a long distance between the center axis of swing motion and a position where the cam is in contact with a cam follower, such as a valve tappet or a rocker arm. The wall thickness of the camshaft provided with the central oil passage of the internal combustion engine disclosed in JP11-294130A must be greater than the depth of a hole in which the pin is fitted, and hence the diameter of the oil passage is limited and the oil passage must be formed in a comparatively small diameter.

When the weight of the decompression member is reduced to reduce the weight of the internal combustion engine, it is preferable to increase the distance between the position of the center of gravity of the decompression member at an initial position from which the decompression member starts swinging and the axis of rotation of the camshaft to ensure that a necessary centrifugal force is produced at a predetermined engine speed at which a decompressing operation is stopped. However, the decompressing means disclosed in JP2001-221023A and JP63-246404A need to increase the length of the decompression member to increase the distance between the center of gravity of the decompression member and the axis of rotation of the camshaft, which, sometimes, increases the diameter of a cylindrical space necessary for the fully expanded decompression member to turn around the camshaft.

When the distance between the center of gravity of the decompression member and the axis of rotation of the camshaft is increased in the prior art decompressing means including the plate-shaped decompression member of a substantially uniform thickness, not only the size of the flyweight but also the size of the decompression member must be increased and, eventually, the cylindrical space around the camshaft occupied by the fully expanded decompression member expands. If increase in the size of the decompression member is avoided, additional working steps such as bending a plate, increases inevitably to form the flyweight having the shape of a plate of a substantially uniform thickness such that the weight is concentrated on the flyweight, the flyweight has a complicated shape that requires difficult machining, the difference in operating characteristic between different decompression member increases.

The present invention has been made in view of the foregoing problems and it is therefore an object of the present invention to reduce the diameter of a cylindrical space around a camshaft in which a fully expanded decompression member revolves.

Another object of the present invention is to form a decompressing means in a comparatively small size, facilitating securing a necessary mass for a flyweight, facilitating manufacturing decompressing means respectively having operating characteristics distributed in a narrow range and to suppress noise generation due to collision between a flyweight and a camshaft, by changing the thickness of a component member of the decompressing means.

SUMMARY OF THE INVENTION

According to one aspect of the present invention, an internal combustion engine comprises: a crankshaft; a camshaft driven for rotation about its axis of rotation in synchronism with the crankshaft; a valve-operating cam mounted on the camshaft; engine valves controlled for opening and closing by the valve-operating cam; and a decompressing means for opening the engine valve during a compression stroke in a starting phase of the internal combustion engine; wherein the camshaft is a hollow shaft having an axial bore extending along the axis of rotation thereof, the decompressing means includes a flyweight supported for swing motion by a holding part formed on the camshaft, and a decompression cam that operates together with the flyweight to exert a valve-opening force on the engine valve, the axis of swing motion of the flyweight is included in a plane substantially perpendicular to the axis of rotation, and does not intersect the axis of rotation and the bore of the camshaft.

In this internal combustion engine, the bore can be formed in the camshaft provided with the decompressing means, the decompression cam can be disposed at a long distance from the axis of swing motion because the axis of swing motion of the flyweight is spaced diametrically from the axis of rotation of the camshaft and the bore of the camshaft, and the position of the center of gravity of the flyweight is far from a reference plane including the axis of rotation and parallel to the axis of swing motion.

Thus, the present invention has the following effects. The camshaft provided with the decompressing means can be a lightweight, hollow shaft and restriction on the diameter of the bore placed by the holding part on the camshaft is reduced because the axis of swing motion of the flyweight of the decompressing means is included in a plane substantially perpendicular to the axis of rotation of the camshaft and does not intersect the axis of rotation and the bore. A decompressing operation can be stopped by the swing of the flyweight through a small angle because the axis of swing motion is spaced diametrically from the axis of rotation and the bore, and the distance between the axis of swing motion and the decompression cam can be increased accordingly, as compared with a distance necessary when the axis of swing motion is substantially perpendicular to the axis of rotation. A cylindrical space in which the fully expanded decompressing means revolves can be contracted toward the axis of rotation of the camshaft, i.e., the diameter of the cylindrical space in which the fully expanded decompressing means revolves can be reduced, by reducing the maximum swing angle of the flyweight, and hence a comparatively large space does not need to be secured for the decompressing means around the camshaft. Consequently, the internal combustion engine can be formed in a small size. Since the center of gravity of the flyweight can be spaced apart from the reference plane by offsetting the center of swing motion, the weight of the flyweight necessary for generating a necessary centrifugal force can be reduced in proportion to the increase of the distance between the center of gravity and the reference plane, which reduces the weight of the internal combustion engine and suppress the expansion of the cylindrical space in which the fully expanded decompressing means operates.

The decompressing means may include an arm connecting the flyweight and the decompression cam, the flyweight may be a block having a thickness along a diameter of the camshaft greater than that of the arm along a diameter of the camshaft.

Thus, in the decompressing means formed by assembling the flyweight, the concentration of mass on the flyweight can be promoted by forming the flyweight and the arm in different thicknesses, respectively, and forming the flyweight in a thickness greater than that of the arm. Thus, increase in the size of the decompressing means can be suppressed, a mass necessary for the decompressing operation and for stopping the decompressing operation can be easily secured, the center of gravity of the flyweight can be easily spaced apart from the reference plane, and the diametrical expansion of the cylindrical space in which the fully expanded decompressing means operates can be suppressed.

The holding part formed on the camshaft may include projections projecting from the outer surface of the camshaft and respectively provided with holding holes. The holding part may include projections formed on the flyweight, and a pin inserted in the projections and the holding hole. The holding part thus formed is capable of pivotally supporting the decompressing means with reliability.

Preferably, the flyweight, the decompression cam and the arm are formed integrally in a single structure by metal injection. Although the flyweight, the decompression cam and the arm respectively having different thicknesses are united together, the flyweight, the decompression cam and the lever can be formed in a high dimensional accuracy. The respective operating characteristics of the thus manufactured decompressing means are distributed in a narrow range, and the decompressing means having a stable operating characteristic can be easily manufactured.

The crankshaft is disposed with its axis of rotation vertically extended, the camshaft is provided in its outer surface with a cut part for receiving the flyweight therein, and the decompressing means may be provided with a return spring capable of exerting a resilient force on the flyweight to set the flyweight at an initial position in the cut part.

Thus, in the vertical internal combustion engine having the crankshaft disposed with its axis of rotation vertically extended, the flyweight is held at the initial position with a part thereof in contact with the camshaft by the resilience of the return spring in an engine speed range for decompressing operation including the stoppage of the camshaft.

Thus, the fully expanded decompressing means operates in a narrow space around the camshaft, a comparatively large space does not need to be secured around the camshaft for the decompressing means, and hence the internal combustion engine can be formed in a small size. Moreover, the flyweight of the decompressing means can be stably held without being affected by gravity, and noise generation due to collision between the flyweight and the camshaft caused by vibrations can be suppressed.

A second cut part for receiving the arm connecting the flyweight and the decompression cam, and the decompression cam may be formed in the outer surface of the camshaft, and the arm may be provided with a contact protrusion that comes into contact with the camshaft to define a full-expansion position for the fully expanded flyweight. The second cut part may be provided with a step with which the contact part comes into contact. Thus, the position for the fully expanded decompressing means can be surely defined.

The second cut part may have a bottom surface along which the arm slides when the flyweight swings. Thus, the operation of the decompressing means is stabilized because the bottom surface guides the arm when the decompressing means swings.

According to another aspect of the present invention, a decompressing lift adjusting method of adjusting decompressing lifts respectively for a first internal combustion engine and a second internal combustion engine respectively having different output characteristics, and respectively comprising fuel feed devices, camshafts, valve-operating cams formed on the camshafts, engine valves controlled for opening and closing by the valve-operating cams, starting devices, and decompressing means respectively provided with decompression cams capable of projecting radially outward from base circles including the heels of the valve-operating cams to open the engine valves during a decompressing operation; wherein the respective decompressing means of the first internal combustion engine and the second internal combustion engine are identical in characteristic quality, and the diameter of the base circle including the heel of the valve-operating cam of the first internal combustion engine and that of the base circle including the heel of the valve-operating cam of the second internal combustion engine are different from each other.

The decompressing lift adjusting method does not need different types of decompressing means respectively for different types of internal combustion engine, and is capable of setting different decompressing lifts, which is effective in reducing the cost of the internal combustion engine.

In this specification, the expression, 'substantially perpendicular' is used for expressing both an exactly perpendicularly intersecting condition and an approximately perpendicularly intersecting condition. Terms, 'diametrical direction' and 'circumferential direction' signify a direction parallel to a diameter of the camshaft and a direction along the outer surface of the camshaft, respectively, unless otherwise specified.

DESCRIPTION OF THE PREFERRED EMBODIMENTS

An internal combustion engine provided with decompressing mechanisms in a preferred embodiment of the present invention will be described with reference to FIGS. 1 to 7.

Figure 1:
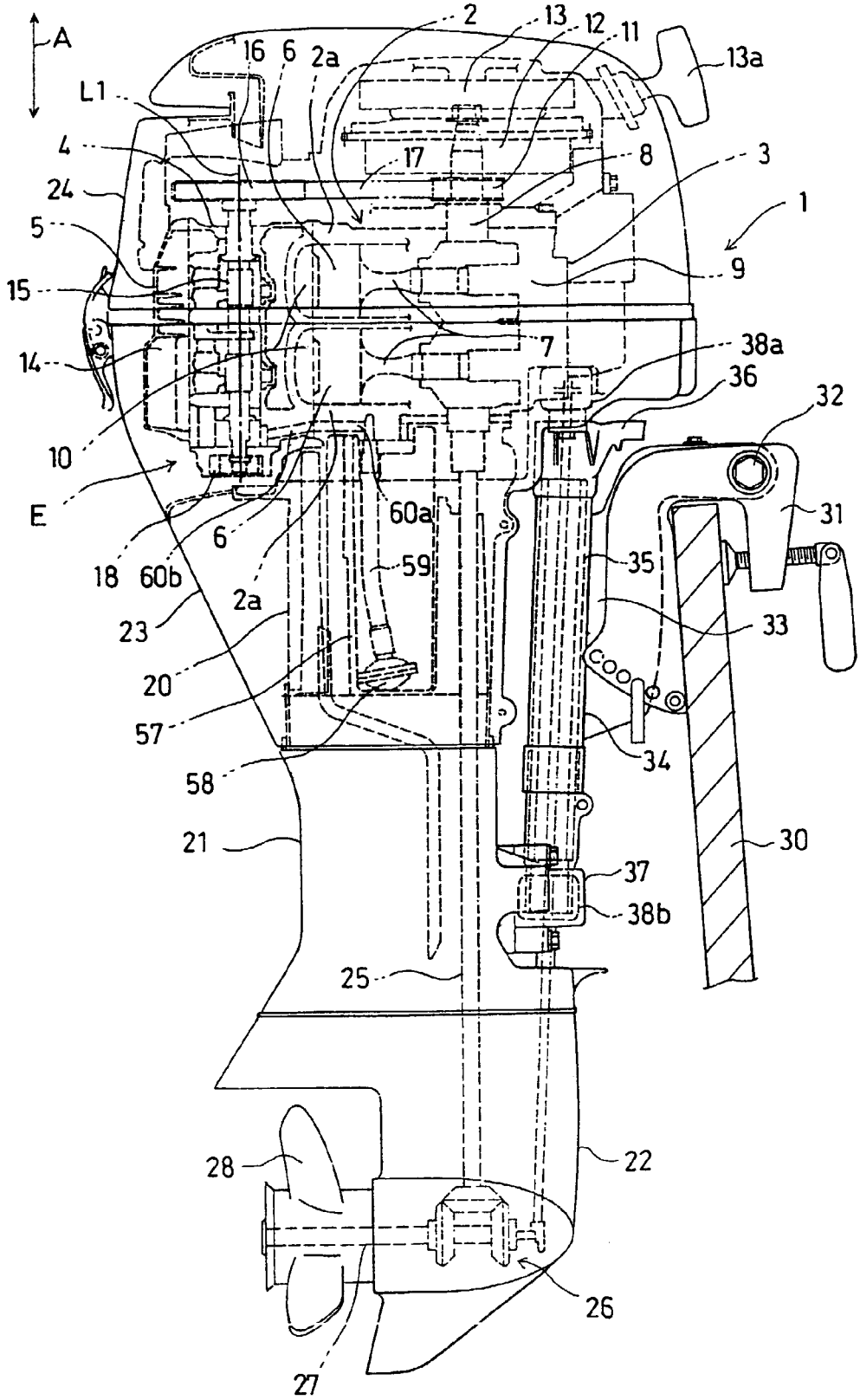
FIG. 1 is a schematic side elevation of an outboard motor including an internal combustion engine provided with decompressing mechanisms in a preferred embodiment according to the present invention.

Referring to FIG. 1, an internal combustion engine E provided with decompressing mechanisms D according to the present invention is a water-cooled, inline, two-cylinder, four-stroke-cycle, vertical internal combustion engine installed in an outboard motor with the axis of rotation of its crankshaft 8 vertically extended. The internal combustion engine E comprises a cylinder block 2 provided with two cylinder bores 2*a* in a vertical, parallel arrangement with their axes longitudinally horizontally extended, a crankcase 3 joined to the front end of the cylinder block 2; a cylinder head 4 joined to the rear end of the cylinder block 2; and a cylinder head cover joined to the rear end of the cylinder head 4. The cylinder block 2, the crankcase 3, the cylinder head 4 and the cylinder head cover 5 constitute an engine body.

A piston 6 is fitted for reciprocating sliding motions in each of the cylinder bores 2*a* and is connected to a crankshaft 8 by a connecting rod 7. The crankshaft 8 is installed in a crank chamber 9 and is supported for rotation in upper and lower plain bearings on the cylinder block 2 and the crankcase 3. The crankshaft 8 is driven for rotation by the pistons 6 driven by combustion pressure produced by the combustion of an air-fuel mixture ignited by spark plugs. The phase difference between the pistons 6 fitted in the two cylinder bores 2*a* corresponds to a crank angle of 360°. Therefore, combustion occurs alternately in the cylinder bores 2*a* at equal angular intervals in this internal combustion engine E. A crankshaft pulley 11 and a rewind starter 13 are mounted in that order on an upper end part of the crankshaft 8 projecting upward from the crank changer 9.

Figure 2:
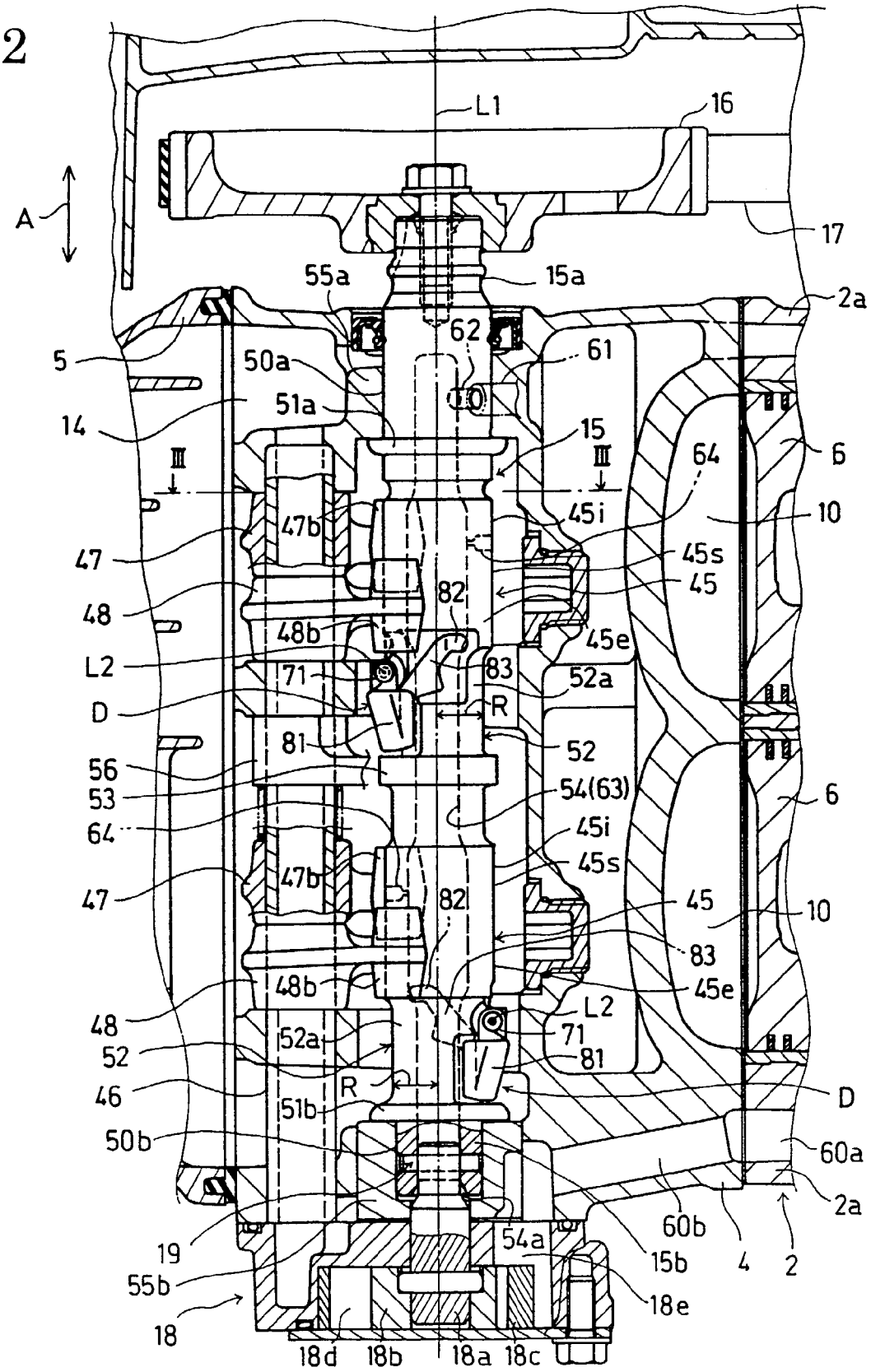
FIG. 2 is a longitudinal sectional view of a cylinder head and associated parts included in the internal combustion engine shown in FIG. 1.

Referring to FIGS. 1 and 2, a camshaft 15 is installed in a valve gear chamber 14 defined by the cylinder head 4 and the cylinder head cover 5 and is supported for rotation on the cylinder head 4 with its axis L1 of rotation extended in parallel with that of the crankshaft 8. A camshaft pulley 16 is mounted on an upper end part 15*a* of the camshaft 15 projecting upward from the valve gear chamber 14. The camshaft 15 is driven for rotation in synchronism with the crankshaft 8 at a rotating speed equal to half that of the crankshaft 8 by the crankshaft 8 through a transmission mechanism including the crankshaft pulley 11, the camshaft pulley 16 and a timing belt 17 extended between the pulleys 11 and 16. A lower end part 15*b* of the camshaft 15 is coupled by a shaft coupling 19 with a pump drive shaft 18*a* connected to the inner rotor 18*b* of a trochoid oil pump 18 attached to the lower end wall of the cylinder head 4.

As shown in FIG. 1, the engine body is joined to the upper end of a support block 20. An extension case 21 has an upper end joined to the lower end of the support block 20 and a lower end joined to a gear case 22. An under cover 23 joined to the upper end of the extension case 21 covers a lower half part of the engine body and the support block 20. An engine cover 24 joined to the upper end of the under cover 23 covers an upper half part of the engine body.

A drive shaft 25 connected to a lower end part of the crankshaft 8 extends downward through the support block 20 and the extension case 21, and is connected to a propeller shaft 27 by a propelling direction switching device 26 including a bevel gear mechanism and a clutch mechanism. The power of the internal combustion engine e is transmitted through the crankshaft 8, the drive shaft 25, a propelling direction switching device 26 and the propeller shaft 27 to a propeller 28 fixedly mounted on a rear end part of the propeller shaft 27 to drive the propeller 28 for rotation.

The outboard motor 1 is detachably connected to a hull 30 by a transom clamp 31. A swing arm 33 is supported for swing motions in a vertical plane by a tilt shaft 32 on the transom clamp 31. A tubular swivel case 34 is connected to the rear end of the swing arm 33. A swivel shaft 35 fitted for rotation in the swivel case 34 has an upper end part provided with a mounting frame 36 and a lower end part provided with a center housing 37. The mounting frame 36 is connected elastically through a rubber mount 38*a* to the support block 20. The center housing 37 is connected elastically through a rubber mount 38*b* to the extension case 21. A steering arm, not shown, is connected to the front end of the mounting frame 36. The steering arm is turned in a horizontal plane for controlling the direction of the outboard motor 1.

Further description of the internal combustion engine E will be made with reference to FIGS. 2 and 3. An intake port 40 through which an air-fuel mixture prepared by a carburetor, not shown, flows into a combustion chamber 10 and an exhaust port 41 through which combustion gases discharged from the combustion chamber 10 flows are formed for each of the cylinder bores 2*a* in the cylinder head 4. An intake valve 42 that opens and closes the intake port 40 and an exhaust valve 43 that opens and closes the exhaust port 41 are urged always in a closing direction by the resilience of valve springs 44. The intake valve 42 and the exhaust valve 43 are operated for opening and closing operations by a valve train installed in the valve gear chamber 14. The valve train includes the camshaft 15, valve-operating cams 45 formed on the camshaft 15 so as to correspond to the cylinder bores 2*a*, intake rocker arms (cam followers) 47 mounted for rocking motion on a rocker shaft 46 fixedly supported on the cylinder head 4 and driven by the valve-operating cams 45, and exhaust rocker arms (cam followers) 48 mounted on the rocker shaft 46 and driven by the valve-operating cams 45.

Each valve-operating cam 45 has an intake cam part 45*i*, an exhaust cam part 45*e*, and a cam surface 45*s* common to the intake cam part 45*i* and the exhaust cam part 45*e*. The intake rocker arm 47 has one end part provided with an adjusting screw 47*a* in contact with the intake valve 42 and the other end provided with a slipper 47*b* in contact with the cam surface 45*s* of the intake cam part 45*i* of the valve-operating cam 45. The exhaust rocker arm 48 has one end provided with an adjusting screw 48*a* in contact with the exhaust valve 43 and the other end provided with a slipper 48*b* in contact with the cam surface 45*s* of the exhaust cam part 45*e* of the valve-operating cam 45. The cam surface 45*s* of the valve-operating cam 45 has a heel 45*a* of a shape conforming to a base circle for keeping the intake valve 42 (exhaust valve 43) closed, and a toe 45*b* that times the operation of the intake valve 42 (exhaust valve 43) and determines the lift of the intake valve 42 (exhaust valve 43). The valve-operating cams 45 rotate together with the camshaft 15 to rock the intake rocker arms 47 and the exhaust rocker arms 48 to operate the intake valves 42 and the exhaust valves 43.

As shown in FIG. 2, the camshaft 15 has the pair of valve-operating cams 45, an upper journal 50*a*, a lower journal 50*b*, an upper thrust-bearing part 51*a* continuous with the upper journal 50*a*, a lower thrust-bearing part 51*b* continuous with the lower journal 50*b*, shaft parts 52 extending between the valve-operating cams 45 and between the valve-operating cam 45 and the lower thrust-bearing part 51*b*, and a pump-driving cam 53 for driving a fuel pump, not shown. The camshaft 15 has a central bore 54 having an open lower end opening in the end surface of the lower end part 15*b* in which the lower journal 50*b* is formed, and a closed upper end in the upper journal 50*a*. The bore 54 extends vertically in the direction of the arrow A parallel with the axis of rotation of the camshaft 15.

The upper journal 50*a* is supported for rotation in an upper bearing 55*a* held in the upper wall of the cylinder head 4, and a lower journal 55*b* is supported for rotation in a lower bearing 55*b* held in the lower wall of the cylinder head 4. Each shaft part 52 has a cylindrical surface 52*a* having the shape of a circular cylinder of a radius R smaller than the radius of the heel 45*a* of a shape conforming to the base circle. The pump-driving cam 53 is formed on the shaft part 52. The pump-driving cam 53 drives a drive arm 56 supported for swinging on the rocker shaft 46 for swing motion to reciprocate the drive rod included in the fuel pump in contact with the drive arm 56.

A lubricating system will be described. Referring to FIG. 1, an oil pan 57 is formed in the support block 20. A lower end provided with an oil strainer 58 of a suction pipe 59 is immersed in a lubricating oil contained in the oil pan 57. The suction pipe 59 has an upper end connected by a joint to an oil passage 60*a* formed in the cylinder block 2. The oil passage 60*a* communicates with the suction port 18*e* (FIG. 2) of the oil pump 18 by means of an oil passage 60*b* formed in the cylinder head 4.

The discharge port, not shown, of the oil pump 18 is connected through oil passages, not shown, formed in the cylinder head 4 and the cylinder block 2, and an oil filter, not shown, to a main oil passage, not shown, formed in the cylinder block 2. A plurality of branch oil passages branch from the main oil passage. The branch oil passages are connected to the bearings and sliding parts including the plain bearings supporting the crankshaft 8 of the internal combustion engine E. One branch oil passage 61 among the plurality of branch oil passages is formed in the cylinder head 4 to supply the lubricating oil to the sliding parts of the valve train and the decompressing mechanisms D in the valve gear chamber 14 as shown in FIG. 2.

The oil pump 18 sucks the lubricating oil into a pump chamber 81*d* formed between an inner rotor 18*b* and an outer rotor 18*c* through the oil strainer 58, the suction pipe 59, the oil passages 60*a* and 60*b* from the oil pan 57. The high-pressure lubricating oil discharged from the pump chamber 18*d* flows through the discharge port, the oil filter, the main oil passage and the plurality of branch passages including the branch passage 61 to the sliding parts.

Part of the lubricating oil flowing through the oil passage 61 opening into the bearing surface of the upper bearing 55*a* flows through an oil passage 62 formed in the upper journal 50*a* and opening into the bore 54. The oil passage 62 communicates intermittently with the oil passage 61 once every one turn of the camshaft 15 to supply the lubricating oil into the bore 54. The bore 54 serves as an oil passage 63. The lubricating oil supplied into the oil passage 63 flows through oil passages 64 opening in the cam surfaces 45*s* of the valve-operating cams 45 to lubricate the sliding surfaces of the slippers 47*a* of the intake rocker arms 47 and the valve-operating cams 45 and to lubricate the sliding surfaces of the slippers 48*b* of the exhaust rocker arms 48 and the valve-operating cams 45. The rest of the lubricating oil flowing through the oil passage 63 flows out of the oil passage 63 through an opening 54*a* to lubricate the sliding parts of the lower bearing 55*b* and the lower journal 50*b*, and the sliding parts of the lower Thrust-bearing part 51*b* and the lower bearing 55*b*, and flows into the valve gear chamber 14. The oil passages 64 does not need to be formed necessarily in parts shown in FIG. 2; the oil passages 64 maybe formed, for example, in parts opposite to the toes 45*b* of the valve-operating cams 45 across the axis L1 of rotation.

The rest of the lubricating oil flowing through the oil passage 61 flows through a small gap between the upper journal 50*a* and the upper bearing 55*a* to lubricate the sliding parts of the Thrust-bearing part 51*a* and the upper bearing 55*a*, flows into the valve gear chamber 14. The lubricating oil flowed through the oil passages 61 and 64 into the valve gear chamber 14 lubricates the sliding parts of the intake rocker arms 47, the exhaust rocker arms 48, the drive arm, and the rocker shaft 46. Eventually, the lubricating oil flowing through the oil passage 61 drops or flows down to the bottom of the valve gear chamber 14, and flows through return passages, not shown, formed in the cylinder head 4 and the cylinder block 2 to the oil pan 57.

Figure 3:
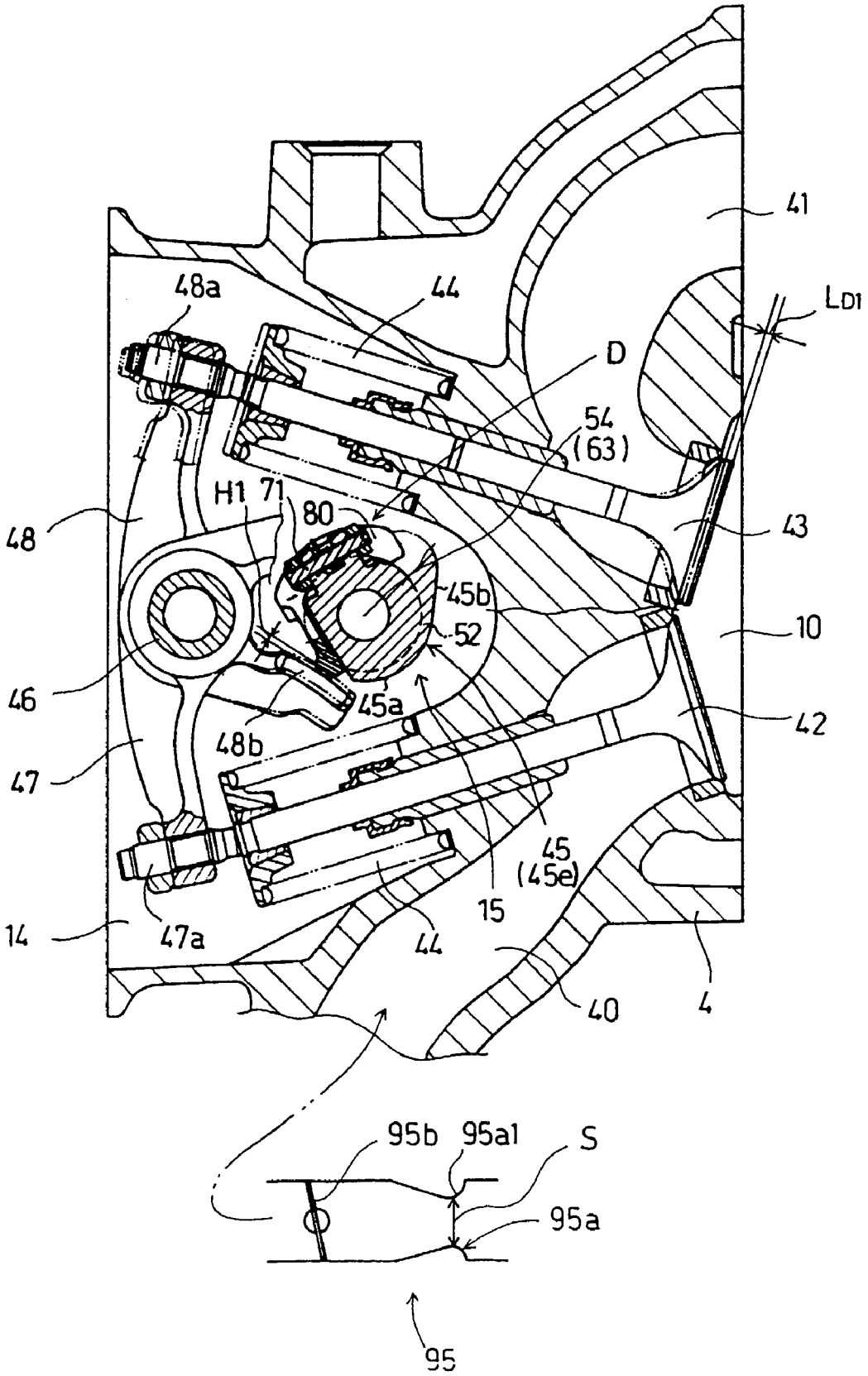
FIG. 3 is a view including a sectional view taken on line III—III in FIG. 2, a sectional view in a plane including the axes of an intake valve and an exhaust valve, and a sectional view of a camshaft similar to FIG. 4.

As shown in FIGS. 2 and 3, the decompressing mechanisms D are combined with the camshaft 15 so as to correspond to the cylinder bores 2*a*, respectively. The decompressing mechanisms D perform a decompressing operation to reduce force necessary for operating the rewind starter 13 in starting the internal combustion engine E. Each decompressing mechanism D lets the corresponding cylinder bore 2*a* discharges the gas contained therein in a compression stroke through the exhaust port 41 to decompress the cylinder bore 2*a*. The decompressing mechanisms D are identical and the difference in phase between the decompressing mechanisms D is equal to a cam angle of 180° corresponding to a crank angle of 360°.

Figure 4:
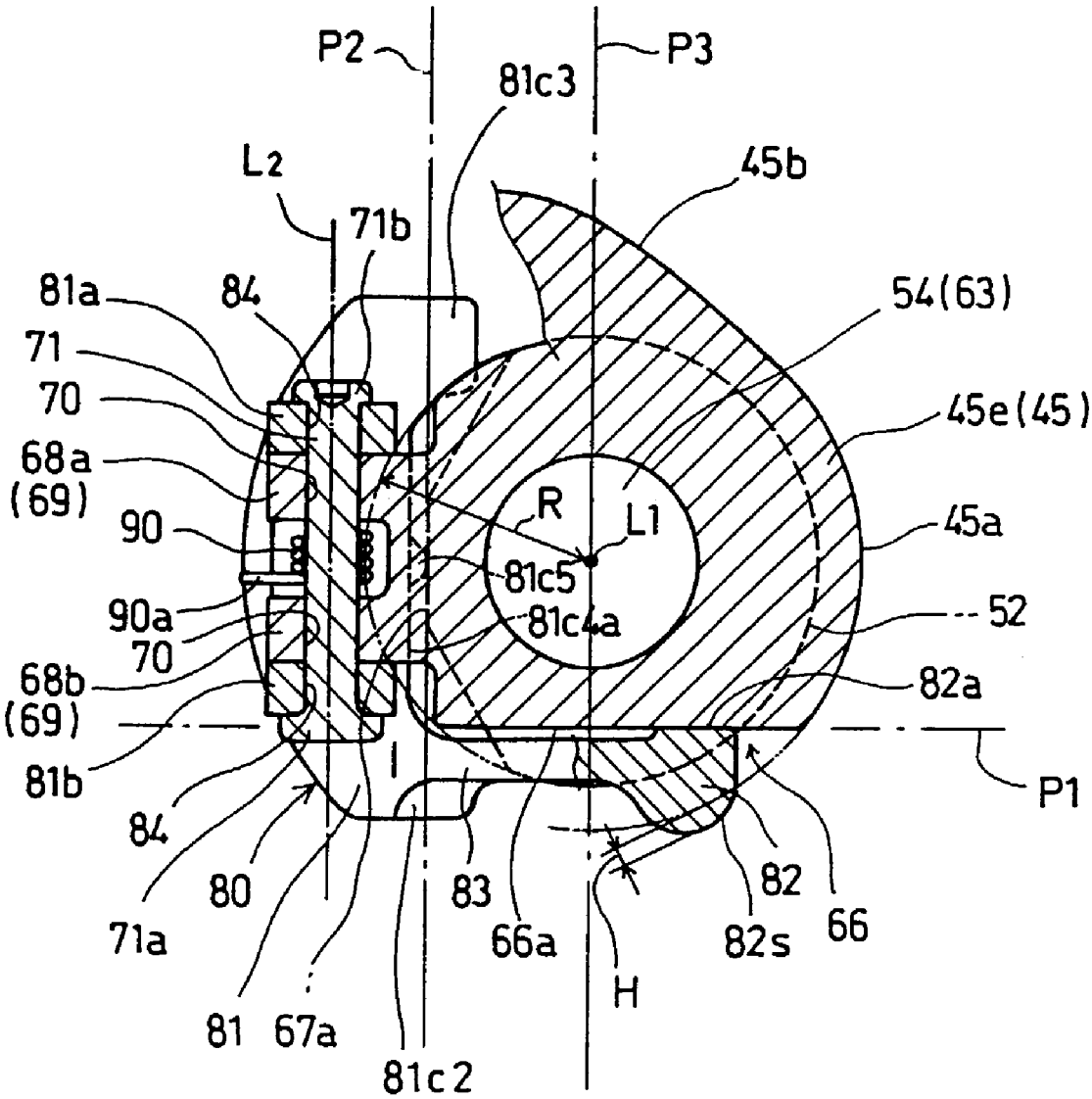
FIG. 4 is a sectional view taken on line IV—IV in FIG. 7A.
Figure 5:
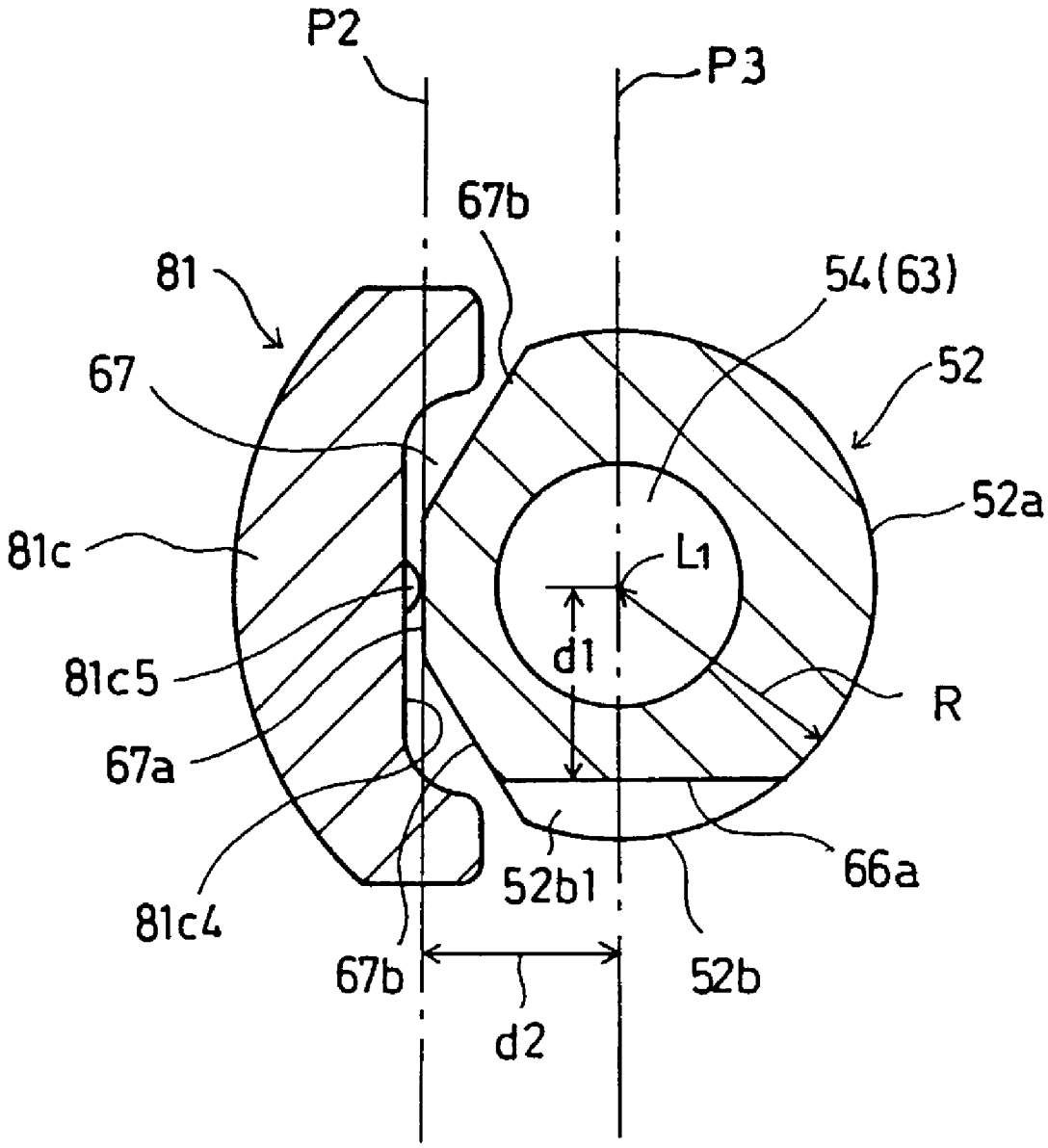
FIG. 5 is a sectional view taken on line V—V in FIG. 7A.
Figure 7A:
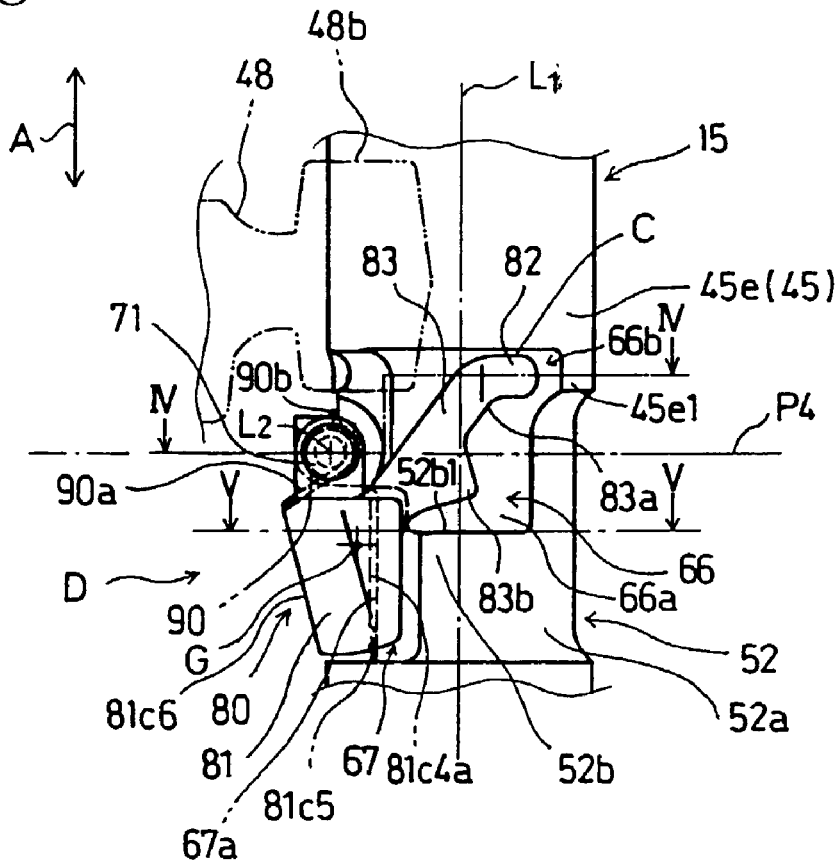
FIG. 7A is an enlarged view of the decompressing mechanism at an initial position.

Referring to FIGS. 4, 5 and 7A, each decompressing mechanism D is formed on the shaft part 52 contiguous with the exhaust cam part 45*e* in contact with the slipper 48*b* of the exhaust rocker arm 48 of the valve-operating cam 45. As shown in FIG. 7A, a cut part 66 is formed between a lower end part 45*e*1 contiguous with the shaft part 52 of the exhaust cam part 45*e*, and the shaft part 52 below the lower end part 45*e*1. The cut part 66 has a bottom surface 66*a* included in a plane P1 (FIG. 4) perpendicular to an axis L2 of swing motion. A cut part 67 is formed in the shaft part 52 so as to extend downward from a position overlapping the cut part 66 with respect to the direction of the arrow A parallel to the axis of rotation. The cut part 67 has a middle bottom surface 67*a* included in a plane P2 perpendicular to the plane P1 and parallel to the axis L1 of rotation, and a pair of end bottom surfaces 67*b* (FIG. 5) inclined to the middle bottom surface 67*a* and parallel to the axis L1 of rotation.

More concretely, the cut part 66 is formed by cutting a part of the lower end part 45*e*1 of the exhaust cam part 45*e* and a part near the exhaust cam part 45*e* of the shaft part 52 such that the distance d1 (FIG. 5) between the axis L1 of rotation of the bottom surface 66*a* is smaller than the radius R of the cylindrical surface 52*a*, and the bottom surface 66*a* is nearer to the axis L1 of rotation than the surface of the shaft part 52. The cut part 67 is formed by cutting part of the shaft part 52 such that the distance d2 (FIG. 5) between the bottom surface 67*a* and a reference plane P3 including the axis L1 of rotation and parallel to the axis L2 of swing motion is smaller than the radius R of the cylindrical surface 52*a*, and the bottom surface 67*a* is nearer to the axis L1 of rotation than the surface of the shaft part 52.

As shown in FIGS. 4 and 7A, a holding part 69 is formed above the cut part 67 in the shaft part 52. The holding part 69 has a pair of projections 68*a* and 68*b* radially outwardly projecting from the shaft part 52 in parallel to the plane P1. The projections 68*a* and 68*b* are provided with holes 70, and a cylindrical pin 71 is fitted in the holes 70 of the arms 68*a* and 68*b*, and a flyweight 81 is supported by the pin 71 for swing motion relative to the camshaft 15. The projections 68*a* and 68*b* are spaced a distance apart in the direction of the axis of the pin 71 and are formed integrally with the camshaft 15.

Figure 6A:
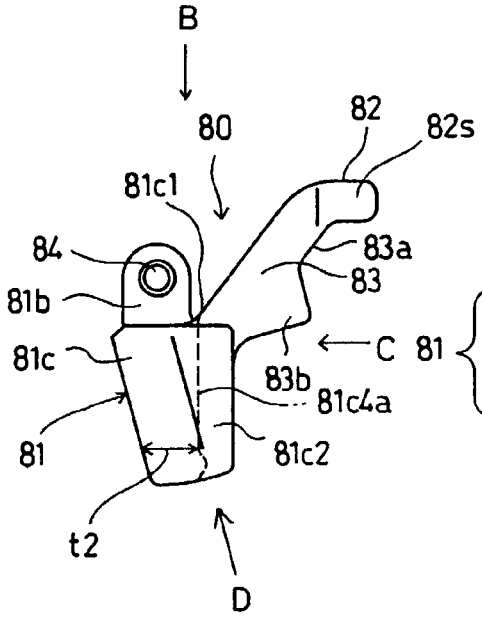
FIG. 6A is a side elevation of a decompression member included in the decompressing mechanism shown in FIG. 1.
Figure 6B:
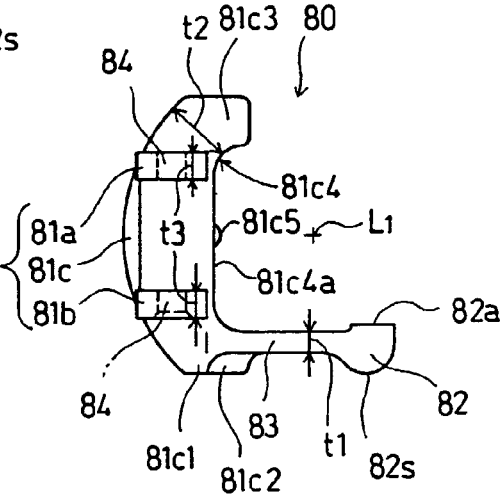
FIG. 6B is a view taken in the direction of the arrow B in FIG. 6A.
Figure 6C:
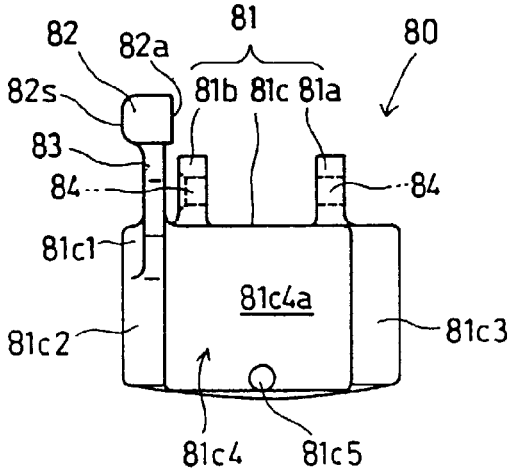
FIG. 6C is a view taken in the direction of the arrow C in FIG. 6A.
Figure 6D:
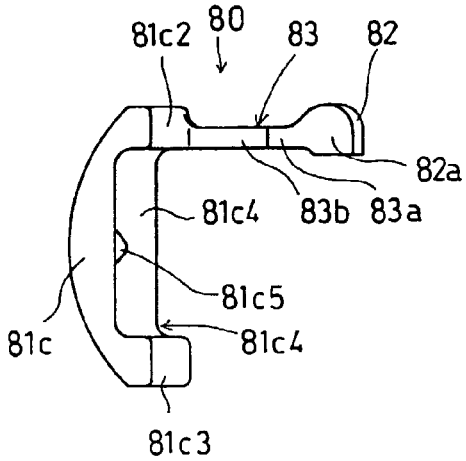
FIG. 6D is a view taken in the direction of the arrow D in FIG. 6A.

Referring to FIGS. 6A to 6C, each decompressing mechanism D includes a decompression member 80 of a metal, such as an iron alloy containing 15% nickel, and a return spring 90. The return spring 90 is a torsion coil spring. The decompression member 80 has the flyweight 81 supported for turning by the pin 71 on the holding part 69, a decompression cam 82 that swings together with the flyweight 81, comes into contact with the slipper 48*b* of the exhaust rocker arm 48 in a starting phase of the internal combustion engine E to exert a valve opening force on the exhaust valve 43, and a flat arm 83 connecting the flyweight 81 and the decompression cam 82. The decompression member 80 is a molding integrally including the flyweight 81, the decompression cam 82 and the arm 83 is formed by metal injection.

The return spring 90 extended between the pair of projections 68*a* and 68*b* has one end 90*a* engaged with the flyweight 81, and the other end 90*b* (FIG. 7A) engaged with the projection 68*a*. The resilience of the return spring 90 is adjusted so that a torque capable of holding the flyweight 81 at an initial position shown in FIG. 7A while the engine speed is below a predetermined engine speed.

The flyweight 81 has a weight body 81*c*, and a pair of flat projections 81*a* and 81*b* projecting from the weight body 81*c* and lying on the outer side of the projections 68*a* and 68*b*, respectively. The projections 81*a* and 81*b* extend from the weight body 81*c* toward the pin 71. The projections 81*a* and 81*b* have a thickness t3, i.e., thickness along the axis L2 of swing motion shown in FIG. 6, slightly greater than the thickness t1 of the arm 83 and smaller than the thickness t2 of the weight body 81*c* of the flyweight 81 shown in FIG. 6 by way of example. The projections 81*a* and 81*b* are provided with holes 84 of a diameter equal to that of the holes 70. The pin 71 is fitted in the holes 70 and 84 so as to be slidable and turnable therein.

Thus, in supporting the flyweight 81 on the camshaft 15, holes 84 of the projections 81*a* and 81*b*, the holes 70 of the projections 68*a* and 68*b* and the return spring 90 are aligned, and then the pin 71 provided with a head 71*a* is inserted from the side of the projection 81*b* in the holes 84 and 70 through the return spring 90. An end part 71*b* of the pin 71 projecting from the other projection 81*a* is pressed to hold the pin 71 in the holes 84 and 70. Thus, the decompression member including the flyweight 81 is supported for swing motion on the camshaft 15. When the decompression member 80 swings, the pin 71 turns together with the decompression member 80 in the holes 70 of the holding part 69.

The axis L2 of swing motion aligned with the axis of the pin 71 is included in a plane P4 (FIGS. 7A and 7B) substantially perpendicular to the axis L1 of rotation of the camshaft 15 and does not intersect the axis L1 of rotation and the bore 54. In this embodiment, the axis L2 of swing motion is at a distance greater than the radius R of the shaft part 52 from the axis L1 of rotation or the reference plane P3 as shown in FIG. 4. Therefore, the holding part 69 having the projections 68*a* and 68*b* is able to set the axis L2 of swing motion at a distance greater than the radius R of the shaft part 52 from the reference plane P3. Consequently, the pin 71 does not intersect the axis L1 of rotation and the bore 54, and is separated diametrically from the axis L1 of rotation and the bore 54.

As best shown in FIGS. 4 and 6, the weight body 81*c* of the flyweight 81 has a thickness t2 along a diametrical direction greater than the thickness t1 of the arm 83. The weight body 81*c* extends from the joint 81*c*1 of the flyweight 81 and the arm 83 on the side of the axis L1 of rotation with respect to the arm 83 along the axis L2 of swing motion to a position on the opposite side of the arm 83 with respect to the axis L1 of rotation, and has opposite end parts 81*c*2 and 81*c*3 with respect to the axis L2 of swing motion extending nearer to the reference plane P3 than the bottom surface 67*a* of the cut part 67. When the decompression member 80 is at the initial position, the outer surface 81*c*6 of the weight body 81*c* extends radially inward with distance from the pin 71 toward the direction of the arrow A. In this embodiment, the outer surface 81*c*6 extends so as to approach radially the shaft part 52 with downward distance. The arm 83 projecting from the weight body 81*c* in a direction different from a direction in which the projections 81*a* and 81*b* extend is received in the cut part 66 when the decompression member 80 is at the initial position and extends along the bottom surface 66*a* on the side of one end part 81*c*2 of the weight body 81*c*.

Figure 7B:
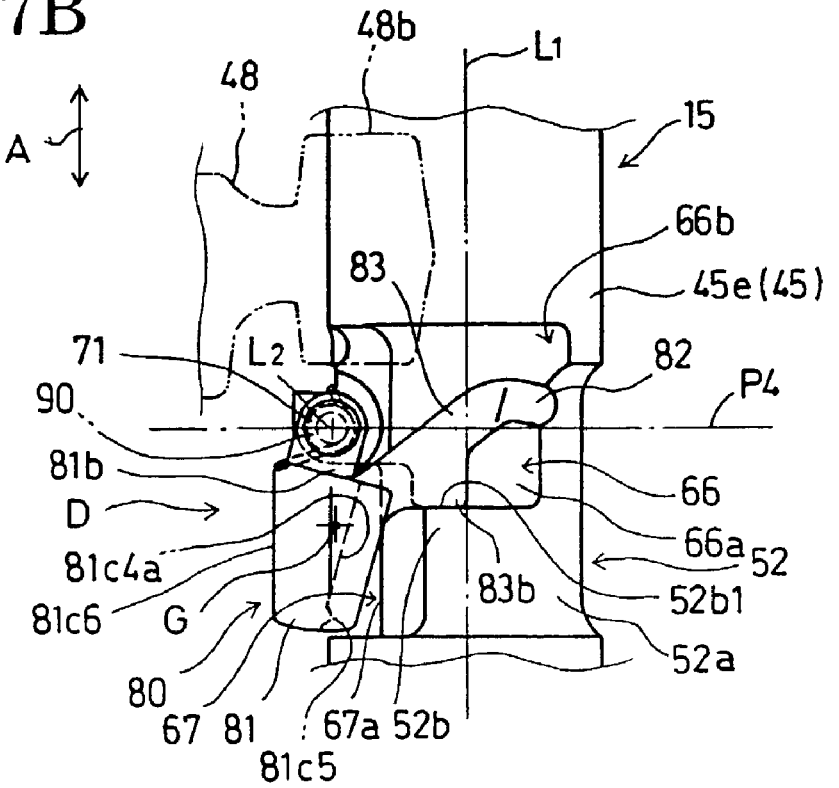
FIG. 7B is a view of the decompressing mechanism at a full-expansion position.

Referring to FIGS. 7A and 7B, a contact protrusion 81*c*5 is formed in a flat part 81*c*4*a* of the inner surface 81*c*4 facing the camshaft 15 of the weight body 81*c*. The contact protrusion 81*c*5 rests on the middle bottom surface 67*a* of the cut part 67 when the flyweight 81 (or the decompression member 80) is set at the initial position. When the decompression member 80 is at the initial position, a gap C (FIG. 7A) is formed between the decompression cam 82 and the valve-operating cam 45 with respect to the direction indicated by the arrow A. A contact protrusion 83*b* (FIG. 6A) is formed on the flat lower end surface of the arm 83. The contact protrusion 83*b* rests on the upper surface 52*b*1 of a step 52*b* (FIG. 7A) adjacent to the bottom surface 66*a* and forming the lower side wall of the cut part 66 to determine a full-expansion position for the radially outward swing motion of the flyweight 81 (or the decompression member 80).

In an initial state where the decompression cam 82 is separated from the slipper 48*b* and the camshaft 15 is stopped, the contact protrusion 81*c*5 is in contact with the middle bottom surface 67*a* (FIG. 5) and the flyweight 81 (or the decompression member 80) stays at the initial position with a part thereof lying in the cut part 67 until the internal combustion engine E is started, the camshaft 15 is rotated, and a torque acting about the axis L2 of swing motion and produced by centrifugal force acting on the decompression member 80 increase beyond an opposite torque produced by the resilience of the return spring 90. When the slipper 48*b* is in contact with the decompression cam 82, the flyweight 81 is restrained from swinging by frictional force acting between the decompression cam 82 and the slipper 48*b* pressed by the resilience of the valve spring 44 against the decompression cam 82 even if the torque produced by the centrifugal force exceeds the opposite torque produced by the resilience of the return spring 90.

When the decompression member 80 is at the initial position, the distance between a flat part 81*c*4*a* (FIG. 6B) farthest from the reference plane P3 of the inner surface 81*c*4 and the reference plane P3 is shorter than the radius R of the cylindrical surface 52*a* as shown in FIG. 4. The center G of gravity (FIG. 7A) of the decompression member 80 is always below the axis L2 of swing motion when the decompression member 80 swings in a maximum range of swing motion between the initial position and the full-expansion position, is slightly on the side of the reference plane P3 with respect to a vertical line crossing the axis L2 of swing motion when the decompression member 80 is at the initial position. Thus, the flyweight 81 approaches the reference plane P3 or the axis L1 of rotation when the flyweight 81 is turned to the full-expansion position.

The decompression cam 82 formed at the extremity of the arm 83 has a cam lobe 82*s* (FIG. 4) protruding in the direction of the axis L2 of swing motion, and a contact surface 82*a* on the opposite side of the cam lobe 82*s*. The contact surface 82*a* is in contact with the bottom surface 66*a* and slides along the bottom surface 66*a* when the arm 83 swings together with the flyweight 81. When the decompression member 80 is at the initial position, i.e., when the decompression member 80 is in the decompressing operation, the decompression cam 82 is on the opposite side of the axis L2 of swing motion and the flyweight 81 with respect to the reference plane P3, is received in an upper part 66*b* (FIG. 7A), contiguous with the exhaust cam part, of the cut part 66, and projects radially by a predetermined maximum height H (FIGS. 3 and 4) from the heel 45*a* of included in the base circle of the valve-operating cam 45. The predetermined height H defines a decompression lift $L_D$ (FIG. 3) by which the exhaust valve 43 is lifted up for decompression.

While the decompression cam 82 is in contact with the slipper 48*b* of the exhaust rocker arm 48 to open the exhaust valve 43, load placed by the resilience of the valve spring 44 on through the exhaust rocker arm 48 on the decompression cam 82 is born by the bottom surface 66*a*. Consequently, load that is exerted on the arm 83 by the exhaust rocker arm 48 during the decompressing operation is reduced and hence the thickness t1 of the arm 83 may be small.

The operation and effect of the embodiment will be described.

While the internal combustion engine E is stopped and the camshaft 15 is not rotating, the center G of gravity of the decompression member 80 is on the side of the reference plane) 3 with respect to the axis L2 of swing motion, and the decompression member 80 is in an initial state where a clockwise torque, as viewed in FIG. 7A, produced by the weight of the decompression member 80 about the axis L2 of swing motion and a counterclockwise torque produced by the resilience of the return spring 90 act on the decompression member 80. Since the resilience of the return spring 90 is determined such that the counterclockwise torque is greater than the clockwise torque, the flyweight 81 (or the decompression member 80) is held at the initial position as shown in FIG. 7A, and the decompression cam 82 is received in the upper part 66*b* contiguous with the exhaust cam part of the cut part 66.

The crankshaft 8 is rotated by pulling a starter knob 13*a* (FIG. 1) connected to a rope wound on a reel included in the rewind starter 13 to start the internal combustion engine E. Then, the camshaft 15 rotates at a rotating speed equal to half the rotating speed of the crankshaft 8. The rotating speed of the crankshaft 8, i.e., the engine speed, is not higher than the predetermined engine speed in this state, and hence the decompression member 80 is held at the initial position because the torque produced by centrifugal force acting on the decompression member 80 is lower than the torque produced by the resilience of the return spring 90. When each cylinder bore 2*a* is in a compression stroke, the decompression cam 82 radially projecting from the heel 45*a* of the valve-operating cam 45 comes into contact with the slipper 48*b* to turn the exhaust rocker arm 48 such that the exhaust valve 43 is lifted up by the predetermined decompression lift $L_D$. Consequently, the air-fuel mixture compressed in the cylinder bore 2*a* is discharged through the exhaust port 41, so that the pressure in the cylinder bore 2*a* decreases, the piston 6 is made easily to pass the top dead center, and hence the rewind starter 13 can be operated by a low force.

After the engine speed has exceeded the predetermined engine speed, the torque produced by the centrifugal force acting on the decompression member 80 exceeds the torque produced by the resilience of the return spring 90. If the decompression cam 82 is separated from the slipper 48*b* of the exhaust rocker arm 48, the decompression member 80 starts being turned clockwise, as viewed in FIG. 7A, by the torque produced by the centrifugal force, the arm 83 slides along the bottom surface 66*a*, the decompression member 80 is turned until the same reaches the full-expansion position where the contact protrusion 83*b* of the arm 83 is in contact with the upper surface 52*b*1 of the step 52*b* as shown in FIG. 7B. With the decompression member 80 at the full-expansion position, the decompression cam 82 is separated from the upper part 66*b* contiguous with the exhaust cam part of the cut part 66 in the direction of the arrow A and is separated fro the slipper 48*b*, so that the decompressing operation is stopped. Consequently, the slipper 48*b* is in contact with the heel 45*a* of the exhaust cam part 45*e* while the cylinder bore 2*a* is in a compression stroke as indicated by two-dot chain lines in FIG. 3 to compress an air-fuel mixture at a normal compression pressure. Thereafter, the engine speed increases to an idling speed. With the decompression member 80 at the full-expanded position, the center G of gravity of the decompression member 80 is at a distance approximately equal to the distance d2 (FIG. 5) between the axis L2 of swing motion and the reference plane P3 from the reference plane P3. Since the outer surface 81*c*6 of the weight body 81*c* of the flyweight 81 extends radially inward with distance from the pin 71 downward, the radial expansion of a cylindrical space in which the flyweight 81 revolves is suppressed, and the circumference of the cylindrical space coincides substantially with the cylindrical surface 52*a* having the shape of a circular cylinder of the shaft part 52.

Since the axis L2 of swing motion of the flyweight 81 of the decompressing mechanism D is included in the plane P4 substantially perpendicular to the axis L1 of rotation of the camshaft 15 and does not interest the axis L1 of rotation and the oil passage 63, i.e., the bore 54, the bore 54 can be formed in the camshaft 15 provided with the decompressing mechanisms D to from the camshaft 15 in a lightweight member, the diameter of the bore 54 is not limited by the pin 71 supported on the camshaft 15 and the bore 54 can be formed in a comparatively big diameter. Thus, the lubricating oil sufficient for lubricating the valve mechanism and the decompressing mechanisms D installed in the valve gear chamber 14 can be supplied through the oil passage 63, i.e., the bore 54. If the camshaft 15 is formed by casting, a core for forming the bore 54 having a comparatively big diameter can be formed more easily than a core of a small diameter for forming an oil passage of a comparatively small diameter because the bore 54 has a comparatively big diameter.

Since the axis L2 of swing motion is separated radially from the axis L1 of rotation and the bore 54, the distance between the axis L2 of swing motion and the decompression cam 82 is longer as compared with that when the axis L2 of swing motion intersects the axis L1 of rotation substantially perpendicularly. Therefore, the flyweight 81 needs to turn only through a small angle to stop the decompressing operation. Since the maximum swing angle of the flyweight 81 is small, the cylindrical space in which the fully expanded decompressing mechanism D can be radially contracted, a comparatively large space does not need to be secured for the decompressing mechanism D around the camshaft 15 and, consequently, the internal combustion engine E can be formed in a comparatively small size. Since the axis L2 of swing motion is spaced radially from the axis L1 of rotation, the position of the center of gravity of the flyweight 81 and hence the center G of gravity of the decompression member 80 can be easily spaced far from the reference plane P3. Since the distance between the position of the center G of gravity of the decomposition member 80 and the axis L1 of rotation is thus increased, the weight of the flyweight 81 for generating a necessary centrifugal force can be reduced accordingly, the internal combustion engine E can be formed in lightweight construction, and the radial expansion of the cylindrical space necessary for the revolution of the fully expanded decompression member 80 and the decompressing mechanisms D can be suppressed.

Since the pin 71 pivotally supporting the flyweight 81 is supported on the holding part 69 including the radial projections 68*a* and 68*b*, the distance between the axis L2 of swing motion and the decompression cam 82 can be increased as compared with that in a state where the axis L2 of swing motion is on the shaft part 52 of the camshaft 15, which also enables reducing the maximum swing angle and contributes to contracting the cylindrical space in which the fully expanded decompression member 80 revolves.

The decompressing mechanism D has the arm 83 connecting the flyweight 81 and the decompression cam 82, and the weight body 81*c* of the flyweight 81 is a block of the thickness t2 in the radial direction greater than the thickness t1 of the arm 83 in the radial direction. Therefore, in the decompression member 80 integrally provided with the flyweight 81, the decompression cam 82 and the arm 83, the respective thicknesses of the weight body 81*c* of the flyweight 81 and the arm 83 are adjusted such that the thickness of the weight body 81*c* is big as compared with that of the arm 83 to concentrate the mass of the flyweight 81 on the weight body 81*c*. Thus, the increase in the size of the decompression member 80 can be suppressed, the distance between the center of gravity of the flyweight 81 having a necessary mass and the reference plane P3 can be easily increased, and the radial expansion of the cylindrical space in which the fully expanded decompression member 80 revolves can be suppressed.

Although the weight body 81*c* of the decompression member 80 is a block, the flat projections 81*a* and 81*b* and the arm 83 are formed in flat shapes of a thickness smaller than the thickness t2 of the weight body 81*c*. The flat projections 81*a* and 81*b* and the arm 83 have necessary rigidity, the masses of the projections 81*a* and 81*b* can be reduced to the least possible extent, and the mass can be concentrated on the weight body 81*c*. Thus, the increase in size of the decompression member 80 can be suppressed and the centrifugal force that acts on the weight body 81*c* can be in creased. Since the projections 81*a* and 81*b* and the arm 83 extend in different directions, respectively from the weight body 81*c*, the projections 81*a* and 81*b*, and the arm 83 can be individually designed. Thus, increase in size of the projections 81*a* and 81*b* that support only the weight body 81*c* can be suppressed as compared with the size of a part supported on a pin and supporting a flyweight and an arm of a conventional decompression member, which contributes to the concentration of the mass on the weight body 81*c*, and to the suppression of increase in size of the flyweight 81 and the decompression member 80.

Load produced by the resilience of the valve spring 44 and placed through the exhaust rocker arm 48 on the decompression cam 82 is born by the bottom surface 66*a*. Thus, the load placed on the arm 83 by the exhaust rocker arm 48 during the decompressing operation can be reduced. Therefore, the thickness t1 of the arm 83 may be small, and the arm 83 can be formed in a small weight. Since the axis L2 of swing motion does not intersect the axis L1 of rotation and the bore 54, and the flyweight 81 is received in the cut part 67, the enlargement of the weight body 81*c* in a radial direction can be suppressed, the weight body 81*c* can be extended along the axis L2 of swing motion to a position on the opposite side of the arm 83 with respect to the axis L1 of rotation, and the opposite end parts 81*c*2 and 81*c*3 can be extended nearer to the reference plane P3 than the middle bottom surface 67*a* of the cut part 67, which further facilitates the concentration of the mass on the flyweight 81 of the decompression member 80.

Although the flyweight 81, the decompression cam 82 and the arm 83 have different thicknesses, respectively, the flyweight 81, the decompression cam 82 and the arm 83 can be integrally formed in a high dimensional accuracy by metal injection. Therefore, the difference in operating characteristic between the decompressing mechanisms D is small, and the decompressing mechanisms D capable of stably exercising the operating characteristic can be easily manufactured.

Since the cut part 67 capable of receiving the flyweight 81 therein is formed near the axis L1 of rotation in the camshaft 15, the cylindrical space for the revolution of the fully expanded decompressing mechanism D extends around the axis L1 of rotation of the camshaft 15 in the vertical internal combustion engine E, a comparatively large space does not need to be secured around the camshaft 15 for the decompressing mechanism D, and the internal combustion engine E can be formed in a small size. Moreover, since the decompressing mechanism D has the contact protrusion 815*c* that comes into contact with the camshaft 15 to define the initial position of the flyweight 81 received in the cut part 67, and the return spring 90 for applying a resilient force to the flyweight 81 to press the flyweight 81 toward the initial position, the flyweight 81 is received in the cut part 67 near the axis L1 of rotation. Therefore, the flyweight 81 can be held at the initial position with the contact protrusion 81*c*5 in contact with the camshaft 15 by the resilience of the return spring 90, can be held stably without being affected by gravity at the initial position, and generation of noise due to collision between the flyweight 81 and the camshaft 15 caused by vibrations can be suppressed regardless of the positional relation of the initial position of the flyweight 81 with the axis L2 of swing motion while the camshaft 15 is stopped and while the internal combustion engine E is operating at engine speeds in an engine speed range for the decompressing operation.

A decompressing mechanism in a modification of the decompressing mechanism D in the foregoing embodiment will be described. Only parts of the decompressing mechanism in the modification different from those of the decompressing mechanism D in the foregoing embodiment will be described.

In the foregoing embodiment, the pin 71 is inserted slidably in the holes 70 of the holding part 69. The pin 71 may be slidably inserted in the holes 84 and may be fixedly pressed in the holes 70, and the flyweight 81 (or the decompression member 80) may be swingably supported on the pin 71. The flyweight 81 can be pivotally supported by the pin 71 on the camshaft 15 provided with the bore 54, and most part of strain developed in the camshaft 15 by the combination of the pin 71 with the camshaft 15 by press fitting can be absorbed by the holding part 69 including the projections 68*a* and 68*b* projecting radially outward from the camshaft by pressing the pin 71 supporting the flyweight 81 in the holding part 69 including the projections 68*a* and 68*b* projecting radially outward from the camshaft 15. Consequently, the deformation of the camshaft 15 and that of the cam surface 45*s* of the valve-operating cam can be suppressed, the abrasion of the sliding parts of the camshaft 15 and the valve-operating cam 45 attributable to such deformations can be reduced, and the durability of the camshaft 15 and the valve-operating cam 45 can be improved.

Although the decompression member 80 of the decompressing mechanism D of the foregoing embodiment is a single member integrally including functional parts, the decompressing mechanism D may include individual members including a flyweight, a decompression cam and an arm, at least one of those members may be a different member, and the flyweight, the decompression cam and the arm may be joined together by fixing means. The holding part 69 may include a single projection instead of the pair of projections 68*a* and 68*b*.

Although the intake valve 42 and the exhaust valve 43 are operated for opening and closing by the single, common valve-operating cam 45 in the foregoing embodiment, the intake valve 42 and the exhaust valve 43 may be controlled by a valve-operating cam specially for operating the intake valve 42 and a valve-operating cam specially for operating the exhaust valve 43, respectively. The intake valve 42 may be operated by the decompressing mechanism D instead of the exhaust valve 43.

Although the center G of gravity of the decompression member 80 is nearer to the reference plane P3 than the axis L2 of swing motion and the decompression member 80 is held at the initial position by the return spring 90 in the foregoing embodiment, the center G of gravity of the decompression member 80 may be farther from reference plane P3 than the axis L2 of swing motion, the decompression member 80 may be held at the initial position by a torque produced by its own weight, and the return spring 90 may be omitted.

Although the camshaft 15 is provided with the oil passage 63 in the foregoing embodiment, a hollow camshaft having a bore 54 not serving as an oil passage may be used. The present invention is applicable also to a horizontal internal combustion engine having a crankshaft having a horizontal axis of rotation. The present invention is applicable not only to the internal combustion engine for the outboard motor, but also for general-purpose internal combustion engines for driving generators, compressors, pumps and such, and those for vehicles. The present invention is applicable to single-cylinder internal combustion engines and multiple cylinder internal combustion engines provided with three or more cylinders.

Although the internal combustion engine in the foregoing embodiment is a spark-ignition engine, the internal combustion engine may be a compression-ignition engine. The starting device may be any suitable starting device other than the rewind starter, such as a kick starter, a manual starter or a starter motor.

Although the axis L2 of swinging motion is at a distance greater tan the radius R of the shaft part 52 from the reference plane P3 in the foregoing embodiment, the distance may be shorter than the radius R, or the axis L2 may be at a distance equal to the radius R, corresponding to a location at the outer surface of the shaft part 52 as shown in FIGS. 7A, 7B. In use, however, the axis L2 of swing motion of the flyweight should be at a distance equal to or greater than the radius R, corresponding to a location at or outside the outer surface of the shaft part 52.

A method of adjusting the decompression lift of the internal combustion engine provided with the foregoing decompressing mechanism will be described hereafter.

The decompressing means for an internal combustion engine disclosed in JP2001-221023A mentioned at the beginning of this specification has a decompression cam having a cam lobe radially protruding from the base circle including the heel of the exhaust cam, the cam lobe comes into contact with the slipper of a rocker arm for operating the exhaust valve to lift up the exhaust valve by a lift (hereinafter, referred to as "decompression lift") for decompression.

In manufacturing different types of internal combustion engines respectively having different output characteristics, it is a usual procedure, for manufacturing the internal combustion engines at low manufacturing costs, to design the internal combustion engines in the same piston displacement, to use engine component parts in common to the internal combustion engines, and to provide the internal combustion engines with different fuel feed devices, respectively.

Although force necessary for operating the starting device is reduced and operability is improved if decompression lift is increased to increase compression pressure reducing rate, the reduction of compression pressure deteriorates the ignitability of the air-fuel mixture compressed in the cylinder and deteriorates the startability of the internal combustion engine. When the same decompression lift is set for different internal combustion engines respectively having different maximum outputs, the decompression lift is determined so as to conform to the internal combustion engine having a high maximum output in view of insuring satisfactory startability of the internal combustion engines. Consequently, the starting device of the internal combustion engine having a low maximum output requires a high operating force, considering its output capacity. The operator of a machine provided with such an internal combustion engine will have a feeling of wrongness.

Therefore, it is desirable to determine different decompression lifts for internal combustion engines having different output characteristics, respectively, taking into consideration the startability of the internal combustion engines and the operability of the starting devices.

However, since different types of decompressing means must be used respectively for different types of internal combustion engines to use different types of decompressing means having, for example, decompression cams of different designs, the costs of the internal combustion engines increase. Since the decompressing means includes comparatively small parts and it is difficult to identify the decompressing means, the different types of decompressing means needs very troublesome product management.

A decompression lift adjusting method capable of solving such problems will be described. When this decompression lift adjusting method is employed, an internal combustion engine provided with a decompressing mechanism capable of achieving a decompressing operation for operating a valve for a suitable decompression lift can be manufactured at low manufacturing costs.

A decompression lift adjusting method according to the present invention will be described below.

Suppose that two internal combustion engines, namely, a first internal combustion engine E1 and a second internal combustion engine E2, are provided with decompressing mechanisms of the same type, and the decompressing mechanisms are controlled by the decompression lift adjusting method of the present invention. The two internal combustion engines E1 and E2 are the same in piston displacement and have different output characteristics, respectively. Both the internal combustion engines E1 and E2 are intended to be used on outboard motors. The basic construction of the first internal combustion engine E1 is the same as that of the foregoing internal combustion engine E. As shown in FIG. 3, the first internal combustion engine E1 of the same construction as the internal combustion engine E have an intake port 40 through which an air-fuel mixture produced by a carburetor 95 is supplied into a combustion chamber 10. The carburetor 95, i.e., a fuel feed device, has a float chamber, not shown, fuel passages including those of a slow system and a main system, not shown, a choke valve, not shown, a venturi tube 95*a* and a throttle valve 95*b*. Each of valve-operating cams 45 has a cam surface 45 formed by machining a cast workpiece for forming a camshaft.

The second internal combustion engine E2 will be described mainly with reference to FIGS. 8 and 9. As mentioned above, the basic construction of the second internal combustion engine E2 is the same as that of the first internal combustion engine E1. Only particulars about the second internal combustion engine E2 different from those about the first internal combustion engine E1 will be described. Parts of the second internal combustion engine E2 excluding a camshaft 115 and corresponding to those of the first internal combustion engine E1 are denoted by the same reference characters.

The second internal combustion engine E2 is incorporated into an outboard motor of the same construction as the outboard motor 1 including the first internal combustion engine E1. Only the carburetor 95 and the camshaft 115 (FIG. 8) of the second internal combustion engine E2 are different from those of the first internal combustion engine E1, and the second internal combustion engine E2 is identical in other respects with the first internal combustion engine E1. Therefore, decompressing mechanisms D included in the second internal combustion engine E2 are identical with those included in the first internal combustion engine E1, while none of the decompression mechanisms is adjustable as shown. The positional relation of the decompressing mechanisms D with the camshaft 115 and the method of supporting the decompressing mechanisms D on the camshaft 115 are the same as those in the first internal combustion engine E1. In the second internal combustion engine E2, a cylinder block 2, a crankcase 3, a cylinder head 4 and a head cover 5, similarly to those of the first internal combustion engine E1, form an engine body. The engine body, pistons 6, connecting rods 7 and a crankshaft 8 forming a main engine unit are the same as those forming the main engine unit of the first internal combustion engine E1. The respective valve mechanisms of the engines E1 and E2 excluding the camshaft 115 are identical.

The intake passage of the carburetor 95 of the second internal combustion engine E2 is small as compared with that of the first internal combustion engine E1, the respective open times of an intake valve 42 and an exhaust valve 43 operated for opening and closing by a valve-operating cam 145 are short, and the respective lifts of the intake valve 42 and the exhaust valve 43 are small in the second internal combustion engine E2, so that the maximum output of the second internal combustion engine E2 is lower than that of the first internal combustion engine E1. The venturi tube of the carburetor of the second internal combustion engine E2 has a throat of a sectional area smaller than the sectional area S (FIG. 3) of the throat 95*a*1 of the venturi tube 95*a* of the carburetor 95. In starting the first internal combustion engine E1 and the second internal combustion engine E2 at a low temperature under the same conditions for operation, the fuel is jetted into the venturi tube of the carburetor of the second internal combustion engine E2 through which intake air flows at a flow rate higher than that of intake air that flows through the venturi tube of the carburetor of the first internal combustion engine D1. Therefore, the fuel can be atomized more satisfactorily in the second internal combustion engine E2 than in the first internal combustion engine E1, and hence the air-fuel mixture can be satisfactorily ignited in the combustion chamber 10.

Figure 8:
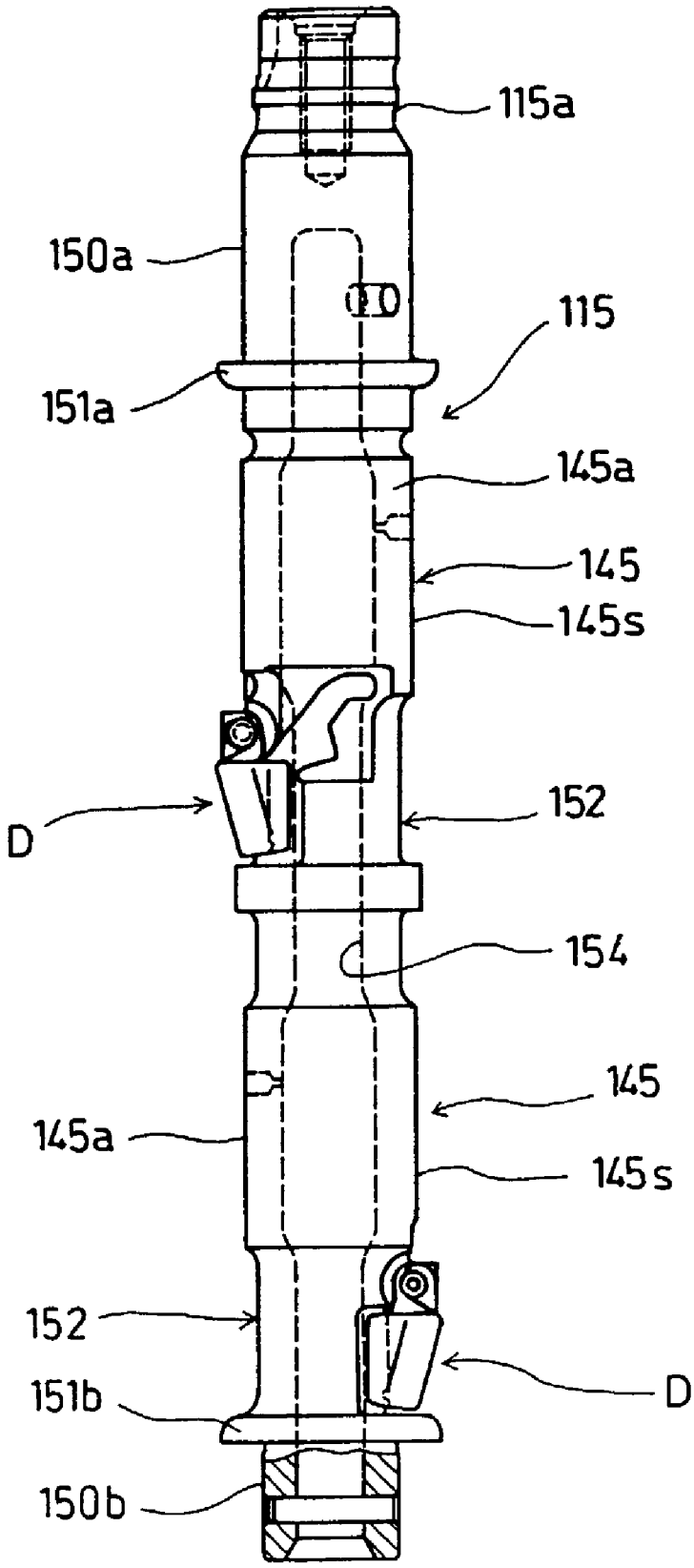
FIG. 8 is a side elevation of a camshaft included in a second internal combustion engine.
Figure 9:
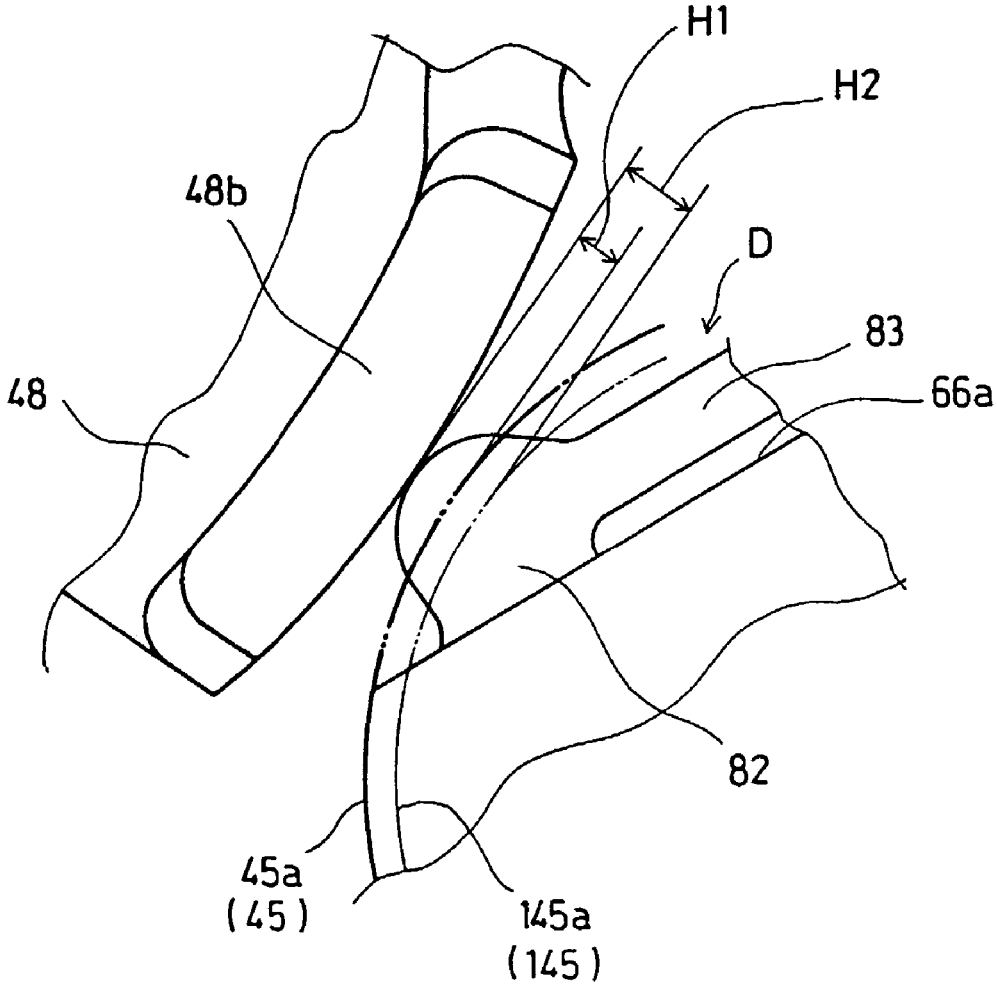
FIG. 9 is view of assistance in explaining the height of a protruding part protruding from the base circle of the cam lobe of a decompression cam in a first internal combustion engine and the second internal combustion engine, in which an imaginary arc of a circle of a diameter equal to that of the base circle is indicated by two-dot chain lines.

Referring to FIG. 8, the camshaft 115 of the second internal combustion engine E2 has an upper journal 150*a*, a lower journal 150*b*, an upper thrust-bearing part 151*a*, a lower thrust-bearing part 151*b*, and shaft pats 152 extending between valve-operating cams 145 and between the valve-operating cam 145 and the lower thrust-bearing part 151*b*, which are the same as those of the camshaft 15 of the first internal combustion engine E1. The camshaft 115 is provided with a bore 154 and has an upper end part 115*a*, which are substantially the same in shape as those of the camshaft 15. Thus, the cam shafts 15 and 115 are interchangeable and can be used in common in the internal combustion engines E1 and E2.

The cam profile of the cam surface 145*s* of the valve-operating cam 145 formed by machining a workpiece for forming the camshaft is different from that of the valve-operating cam 45 of the first internal combustion engine E1. More concretely, in the valve-operating cam 145 of the second internal combustion engine E2, the diameter of a base circle including a heel 145 formed on the valve-operating cam 145 is smaller than that of the base circle including the heel 45*a* of the valve-operating cam 45. The working angle and the height of the toe of the valve-operating cam 145 are smaller than the working angle and the height of the toe 45*b*, respectively. Consequently, the respective opening times of the intake valve 42 and the exhaust valve 43 of the second internal combustion engine E2 are shorter than those of the intake valve 42 and the exhaust valve 43 of the first internal combustion engine E1, and the respective lifts of the intake valve 42 and the exhaust valve 43 of the second internal combustion engine E2 are smaller than those of the intake valve 42 and the exhaust valve 43 of the first internal combustion engine E1.

The diameter of the base circle including a heel 145*a* included in the valve-operating cam 145 is smaller than that of the base circle including the heel 45*a* of the valve-operating cam 45. Therefore, as shown in FIG. 9, the predetermined height H2 of a part radially projecting from the base circle including the heel 145*a* of the decompression cam 82 of the decompressing mechanism D of the second internal combustion engine E2 is greater than the predetermined height H1 of a part radially projecting from the base circle including the heel 45*a* of the decompression cam 82 of the decompressing mechanism D of the first internal combustion engine E1. Thus, the maximum decompression lift of the exhaust valve 48 of the second internal combustion engine E2 dependent on the predetermined height H2 when the decompression cam 82 comes into contact with the slipper 48*b* to turn the exhaust rocker arm 48 is greater than the decompression lift $L_{D1}$ of the exhaust valve of the first internal combustion engine E1. Thus, proper decompression lifts can be determined for the first internal combustion engine E1 and the second internal combustion engine E2 having different output characteristics by forming the heels 45*a* and 145*a* of the valve-operating cams 45 and 145 of the camshafts 15 and 115, respectively, of the first internal combustion engine E1 and the second internal combustion engine E2 by machining so that the diameters of the base circles respectively including the heels 45*a* and 145*a* have different diameters, respectively.

The respective decompressing mechanisms D of the first internal combustion engine E1 and the second internal combustion engine E2 are the same in all the particulars. The same decompressing mechanism can be applied to the internal combustion engines E1 and E2 of different output characteristics, namely, internal combustion engines E1 and E2 of different types, by forming the heel 45*a* of the valve-operating cam 45 of the first internal combustion engine E1 and the heel 145*a* of the valve-operating cam 145 of the second internal combustion engine E2 such that the heels 45*a* and 145*a* are included in the base circles of different diameters, respectively. Since the camshafts 15 and 115 are formed by machining specially for the internal combustion engine E1 and E2, respectively, the proper decompression lifts can be determined for the internal combustion engine E1 and E2 by forming the heels 45*a* and 145*a* respectively included in base circles of different diameters for the valve-operating cams 45 and 145, which is not a factor that increases the costs. Consequently, the internal combustion engine E1 and E2 provided with the decompressing mechanisms D capable of providing proper decompression lifts for the decompressing operation can be manufactured at a low cost, and the decompressing mechanisms D are easy to manage.

The diameter of the base circle including the heel 145*a* of the valve-operating cam 145 of the second internal combustion engine E2, in which the ignitability of the air-fuel mixture compressed in the cylinder of the second internal combustion engine E2 in the starting phase of the second internal combustion engine E2 is better than that in the first internal combustion engine E1, is smaller than that of the base circle including the heel 45*a* of the valve-operating cam 45 of the first internal combustion engine E1. Although the decompression lift and the reduction of compression pressure in the second internal combustion engine E1 are greater than those in the first internal combustion engine E1, satisfactory startability of the second internal combustion engine E2 is insured because the ignitability of the air-fuel mixture in the second internal combustion engine E2 is satisfactory, and the operability of the wind starter 13 is improved significantly. In the first internal combustion engine E1, which is inferior in the ignitability of the air-fuel mixture to the second internal combustion engine E2, the decompression lift is smaller than that of the second internal combustion engine E2 and the compression pressure is higher than that in the second internal combustion engine E2. Therefore, the first internal combustion engine E1 has improved startability, and the operability of the rewind starter 13 is improved by a degree not as high as that in the second internal combustion engine E2 though. Therefore, the startability of the first internal combustion engine E1 is improved, the operability of the rewind starter 13 of the first internal combustion engine E1 is improved. Since the operability of the rewind starter 13 of the second internal combustion engine E2 is improved greatly, the startability of the second internal combustion engine E2 is satisfactory or improved. Thus, the internal combustion engine E1 and E2 provided with the rewind starters 13 having improved operability can be obtained.

The sectional area of the throat of the venturi tube of the carburetor of the second internal combustion engine E2 whose maximum output is lower than that of the first internal combustion engine E1 is smaller than the sectional area S of the throat of the venturi tube of the carburetor of the first internal combustion engine E1. The fuel is atomized satisfactorily by the carburetor having the venturi tube having a small throat diameter of the second internal combustion engine E2 whose maximum output is low and hence the ignitability of the air-fuel mixture produced by this carburetor is satisfactory. Thus, the first internal combustion engine E1 having excellent startability and capable of providing a high maximum output is often used on comparatively large devices, while the second internal combustion engine E2 provided with the rewind starter 13 excellent in operability is often used on comparatively small devices in which the high operability of the rewind starter is important.

The principal engine parts of the first internal combustion engine E1 and the second internal combustion engine E2 are interchangeable, the internal combustion engine E1 and the second internal combustion engine E2 have the same piston displacement, and the camshaft 15 of the first internal combustion engine E1 and the camshaft 115 of the second internal combustion engine E2 are interchangeable. Thus, the further reduction of the costs of the internal combustion engines E1 and E2 respectively having different output characteristics is possible.

A fuel injection device may be used instead of the carburetor as the fuel feed device. Different spark plugs may be used or a desired number of spark plugs may be used for one combustion chamber to enhance the ignitability of the air-fuel mixture in the combustion chamber. Although the principal engine parts and the camshafts 15 and 115 of the internal combustion engines E1 and E2 in the foregoing embodiment are interchangeable, only some of those may be interchangeable.

What is claimed is:

1. An internal combustion engine comprising: a crankshaft; a camshaft driven for rotation about an axis of rotation thereof in synchronism with the crankshaft; a valve-operating cam provided on the camshaft; engine valves controlled for opening and closing by the valve-operating cam; and a decompressing mechanism which opens the engine valve during a compression stroke in a starting phase of the internal combustion engine;

wherein the camshaft is a hollow shaft having an axial bore that extends along an axis of rotation thereof and forms a lubricating oil passage, the decompressing mechanism includes a flyweight supported for swinging motion by a holding part provided on the camshaft, and a decompression cam that operates together with the flyweight to exert a valve-opening force on the engine valve, the flyweight having an axis of swing motion that is included in a plane substantially perpendicular to the camshaft axis of rotation and that does not intersect the axis of rotation and the bore of the camshaft; and wherein the flyweight is disposed such that the axis of swing motion thereof is located at or outside an outer surface of the camshaft.

2. The internal combustion engine according to claim 1, wherein the decompressing mechanism includes an arm connecting the flyweight and the decompression cam, the flyweight is a block having a thickness along a diameter of the camshaft greater than a thickness of the arm along the diameter of the camshaft.

3. An internal combustion engine comprising: a crankshaft; a camshaft driven for rotation about an axis of rotation thereof in synchronism with the crankshaft; a valve-operating cam provided on the camshaft; engine valves controlled for opening and closing by the valve-operating cam; and a decompressing mechanism which opens the engine valve during a compression stroke in a starting phase of the internal combustion engine;

wherein the camshaft is a hollow shaft having an axial bore extending that extends along an axis of rotation thereof, the decompressing mechanism includes a flyweight supported for swinging motion by a holding part provided on the camshaft, and a decompression cam that operates together with the flyweight to exert a valve-opening force on the engine valve, the flyweight having an axis of swing motion that is included in a plane substantially perpendicular to the camshaft axis of rotation and that does not intersect the axis of rotation and the bore of the camshaft, and wherein the holding part on the camshaft includes projections projecting from an outer surface of the camshaft and respectively provided with holding holes.

4. The internal combustion engine according to claim 3, wherein the holding part further includes projections formed on the flyweight and a pin inserted in the flyweight projections and the holding holes of the camshaft projections.

5. The internal combustion engine according to claim 2, wherein the flyweight, the decompression cam and the arm are formed integrally in a single structure by metal injection.

6. The internal combustion engine according to claim 1, wherein the crankshaft is disposed with its axis of rotation vertically extended, the camshaft is provided in its outer surface with a cut part for receiving the flyweight therein, and the decompressing mechanism further includes a return spring capable of exerting a resilient force on the flyweight to set the flyweight at an initial position in the cut part.

7. An internal combustion engine comprising: a crankshaft; a camshaft driven for rotation about an axis of rotation thereof in synchronism with the crankshaft; a valve-operating cam provided on the camshaft; engine valves controlled for opening and closing by the valve-operating cam; and a decompressing mechanism which opens the engine valve during a compression stroke in a starting phase of the internal combustion engine;

wherein the camshaft is a hollow shaft having an axial bore that extends along an axis of rotation thereof and forms a lubricating oil passage, the decompressing mechanism includes a flyweight supported for swinging motion by a holding part provided on the camshaft, and a decompression cam that operates together with the flyweight to exert a valve-opening force on the engine valve, the flyweight having an axis of swing motion that is included in a plane substantially perpendicular to the camshaft axis of rotation and that does not intersect the axis of rotation and the bore of the camshaft, wherein the crankshaft is disposed with its axis of rotation vertically extended, the camshaft is provided in its outer surface with a cut part for receiving the flyweight therein, and the decompressing mechanism further includes a return spring capable of exerting a resilient force on the flyweight to set the flyweight at an initial position in the cut part, and wherein a second cut part for receiving an arm connecting the flyweight and the decompression cam, and the decompression cam is formed in the outer surface of the camshaft and the arm has a contact protrusion that comes into contact with the camshaft to define a full-expansion position for the flyweight.

8. The internal combustion engine according to claim 7, wherein the second cut part is provided with a step with which the contact protrusion comes into contact.

9. The internal combustion engine according to claim 8, wherein the second cut part has a bottom surface along which the arm slides when the flyweight swings.

10. A decompressing lift adjusting method of adjusting decompressing lifts respectively for a first internal combustion engine and a second internal combustion engine having different output characteristics, respectively, and respectively comprising fuel feed devices, camshafts, valve-operating cams formed on the camshafts, engine valves controlled for opening and closing by the valve-operating cams, starting devices, and camshaft-mounted decompressing mechanisms respectively provided with decompression cams capable of projecting radially outward from base circles including heels of the valve-operating cams to open the engine valves during a decompressing operation;

wherein the method comprises steps of; providing the respective decompressing mechanisms of the first internal combustion engine and the second internal combustion engine which are made substantially identical in structural characteristics; and selecting a base circle including the heel of the valve-operating cam of the first internal combustion engine and a base circle including the heel of the valve-operating cam of the second internal combustion engine made to have respective diameters thereof that are different from each other.

11. The decompressing lift adjusting method according to claim 10, wherein the diameter of the base circle including the heel of the valve-operating cam of the second internal combustion engine is smaller than that of the base circle including the heel of the valve-operating cam of the first internal combustion engine, when ignitability of an air-fuel mixture in the second internal combustion engine in a starting phase of the second internal combustion engine is higher than that of an air-fuel mixture in the first internal combustion engine in a starting phase of the first internal combustion engine.

12. The decompressing lift adjusting method according to claim 11, wherein the fuel feed devices are carburetors, and said method further includes a step of providing a sectional area of a throat of a venturi tube included in the carburetor of the second internal combustion engine which is smaller than that of a throat of a venturi tube included in the carburetor of the first internal combustion engine when a maximum output of the second internal combustion engine is lower than that of the first internal combustion engine.

13. The decompressing lift adjusting method according to claim 11, wherein main engine parts of the first internal combustion engine and the second internal combustion engine are interchangeable, the first internal combustion engine and the second internal combustion engine have the same piston displacement, and the respective camshafts of the first internal combustion engine and the second internal combustion engine are interchangeable.

14. An internal combustion engine comprising: a crankshaft; a camshaft driven for rotation about an axis of rotation thereof in synchronism with the crankshaft; a valve-operating cam mounted on the camshaft; engine valves controlled for opening and closing by the valve-operating cam; and a decompressing means for opening the engine valve during a compression stroke in a starting phase of the internal combustion engine;

wherein the camshaft is a hollow shaft having an axial bore extending along an axis of rotation thereof, the decompressing means includes a flyweight supported for swinging motion by a holding part formed on the camshaft, and a decompression cam that operates together with the flyweight to exert a valve-opening force on the engine valve, the flyweight having an axis of swinging motion that is included in a plane substantially perpendicular to the axis of rotation and that does not intersect the axis of rotation and the bore of the camshaft and wherein the flyweight is disposed such that the axis of swing motion thereof is located at or outside of an outer surface of the camshaft.

15. The internal combustion engine according to claim 1, wherein the flyweight has the axis of swing motion thereof located in an axial region of the camshaft where the axial bore forming the lubricating oil passage is provided.

16. The decompressing lift adjusting method according to claim 10, wherein the decompression mechanisms of the first internal combustion engine and the second internal combustion engine are non-adjustable.

* * * * *